US007491683B2

(12) United States Patent
Komiya et al.

(10) Patent No.: US 7,491,683 B2
(45) Date of Patent: Feb. 17, 2009

(54) GREASE COMPOSITION FOR ROLLING BEARING AND ROLLING BEARING USING THE SAME

(75) Inventors: Hiroshi Komiya, Nara (JP); Seiji Okamura, Hyogo (JP); Hiroki Iwamatsu, Hyogo (JP)

(73) Assignees: JTEKT Corporation, Osaka (JP); Nippon Grease Co., Ltd., Kobe-Shi, Hyogo (JP)

( * ) Notice: Subject to any disclaimer, the term of this patent is extended or adjusted under 35 U.S.C. 154(b) by 784 days.

(21) Appl. No.: 10/882,686

(22) Filed: Jul. 2, 2004

(65) Prior Publication Data

US 2005/0043190 A1 Feb. 24, 2005

(30) Foreign Application Priority Data

Jul. 4, 2003 (JP) ..... P. 2003-191578

(51) Int. Cl.
*C10M 169/04* (2006.01)

(52) U.S. Cl. ..... 508/183

(58) Field of Classification Search ..... 508/183
See application file for complete search history.

(56) References Cited

U.S. PATENT DOCUMENTS

| | | | | |
|---|---|---|---|---|
| 5,576,273 | A * | 11/1996 | Karol et al. | 508/364 |
| 5,612,298 | A | 3/1997 | Bae et al. | |
| 5,840,664 | A * | 11/1998 | Karol et al. | 508/283 |
| 2001/0012821 | A1* | 8/2001 | Koishikawa et al. | 508/416 |
| 2002/0013232 | A1* | 1/2002 | Kinoshita et al. | 508/364 |

FOREIGN PATENT DOCUMENTS

| | | | |
|---|---|---|---|
| DE | 43 93 753 | T1 | 7/1997 |
| EP | 0 675 192 | A1 | 10/1995 |
| EP | 1 160 308 | A2 | 12/2001 |
| EP | 1 388 584 | A1 | 2/2004 |
| JP | 8-41478 | | 2/1996 |
| JP | 2000-303088 | | 10/2000 |
| WO | WO 94/03565 | | 2/1994 |
| WO | WO 94/24100 | | 10/1994 |
| WO | WO 01/32612 | A1 | 5/2001 |

OTHER PUBLICATIONS

European Search Report dated Oct. 21, 2004.
European Search Report, dated Jan. 10, 2005.

* cited by examiner

*Primary Examiner*—Walter D Griffin
*Assistant Examiner*—Frank C Campanell
(74) *Attorney, Agent, or Firm*—McGinn IP Law Group, PLLC

(57) ABSTRACT

Bismuth dithiocarbamate (BiDTC) is added to a urea grease containing a lubricating base oil having a poly-α-olefin synthetic oil or a diphenyl ether synthetic oil and a diurea thickening agent, or a fluorine grease containing a lubricating base oil having fluorinated synthetic oil and a polytetrafluoroethylene thickening agent. By taking such constitution as described above, a surface film is formed on a surface of a raceway of any one of inner and outer rings or a surface of a rolling element of a bearing. Therefore, the rolling bearing in which a grease composition having the constitution is packed can maintain an excellent lubricity for a long period of time even under severe conditions such as a high rotation, a high temperature and a heavy load. Further, the grease composition for the rolling bearing is low in harmfulness to a human body and gives little load to the environment.

16 Claims, 1 Drawing Sheet

GREASE COMPOSITION FOR ROLLING BEARING AND ROLLING BEARING USING THE SAME

FIELD OF THE INVENTION

The present invention relates to a grease composition for a rolling bearing to be used under severe conditions such as a high speed rotation, a high temperature and a heavy load, and the rolling bearing using the grease composition.

BACKGROUND OF THE INVENTION

A bearing for use in, for example, an alternator which is an auxiliary device of an automotive engine, is used under severe conditions such as a high speed rotation, a high temperature and a heavy load. Therefore, a lubricant (grease) to be used for such bearing as described above has been required to maintain a sufficient lubricity for a long period of time without causing problems such as seizure of the bearing under the above-described conditions and, accordingly, various types of greases or grease compositions for rolling bearings have so far been proposed.

In order to comply with such requirement, the present inventors have proposed a grease composition for a rolling bearing comprising a lubricating base oil comprising a poly-α-olefin synthetic oil or a diphenyl ether synthetic oil, a diurea thickener and an organic antimony compound or an organic molybdenum compound as a lubricant which can maintain an excellent lubricity for a long period of time under a high temperature condition (about 170° C. or more) (refer to WO94/03565 pamphlet).

Further, the present inventors have proposed a grease composition for a rolling bearing comprising a lubricating base oil comprising a fluorinated synthetic oil, a polytetrafluoroethylene thickening agent and an organic antimony compound or an organic molybdenum compound, as a lubricant capable of being used under a higher temperature (about 200° C. or more) (refer to JP-A-2000-303088).

On the other hand, in a recent trend in which an importance of corresponding to an environmental problem is increasing, a requirement for reduction of an amount of a heavy metal to be used which is suspected of giving a damage to a global environment or for disuse thereof is increasing. Particularly, antimony (Sb) was designated as a substance which falls in environmental standard articles in the revised environmental standard for water quality in 1993. For this account, although the heavy metal contained in the above-mentioned grease for the rolling bearing is not, today, designated as an object for being restricted by a law, it is well anticipated that usage of the heavy metal is restricted in the future and it becomes necessary for the heavy metal to be replaced by a less hazardous element.

SUMMARY OF THE INVENTION

The present invention has been attained in order to meet the above-described problems and it is an object of the present invention to provide a grease composition for rolling bearing which can maintain an excellent lubricating performance even when used under particularly severe conditions, gives little influence to the environment and is safe, and a rolling bearing using the grease composition.

The present inventors have found that a rolling fatigue life span of a bearing to be used under severe conditions can be extended by adding a compound capable of forming a film on a surface of a raceway of each of inner and outer rings or a surface of a rolling element of a bearing in a grease composition for a rolling bearing as an extreme pressure additive. Then, the present inventors have conducted studies on various types of extreme pressure additives which each have a similar effect of enhancing lubricating performance to that of an organic antimony compound or an organic molybdenum compound and, also, is low in harmfulness to a human body and, as a result, found that a similar effect of extending the fatigue life span to that of a previous proposal can be obtained by adding bismuth dithiocarbamate to a grease base agent (mixture of base oil and thickening agent) which has a high thermal resistance.

The present invention has been achieved based on these findings and, in order to attain the above-mentioned object, a grease composition for a rolling bearing is characterized by comprising a lubricating base oil comprising a poly-α-olefin synthetic oil or a diphenyl ether synthetic oil, a diurea thickening agent and a bismuth dithiocarbamate represented by the following general formula (1):

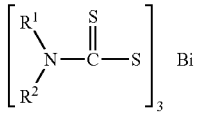

(1)

wherein $R^1$ and $R^2$ are same as or different from each other and each individually represents a hydrogen atom, an alkyl group or an aryl group.

Further, as a measure to attain the same object, a grease composition for the rolling bearing is characterized by comprising a lubricating base oil comprising a fluorinated synthetic oil, a polytetrafluoroethylene thickening agent and a bismuth dithiocarbamate represented by the following general formula (1):

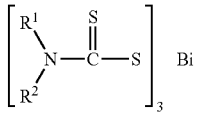

(1)

wherein $R^1$ and $R^2$ are same as or different from each other and each individually represents a hydrogen atom, an alkyl group or an aryl group.

DETAILED DESCRIPTION OF THE INVENTION

Figure 1:
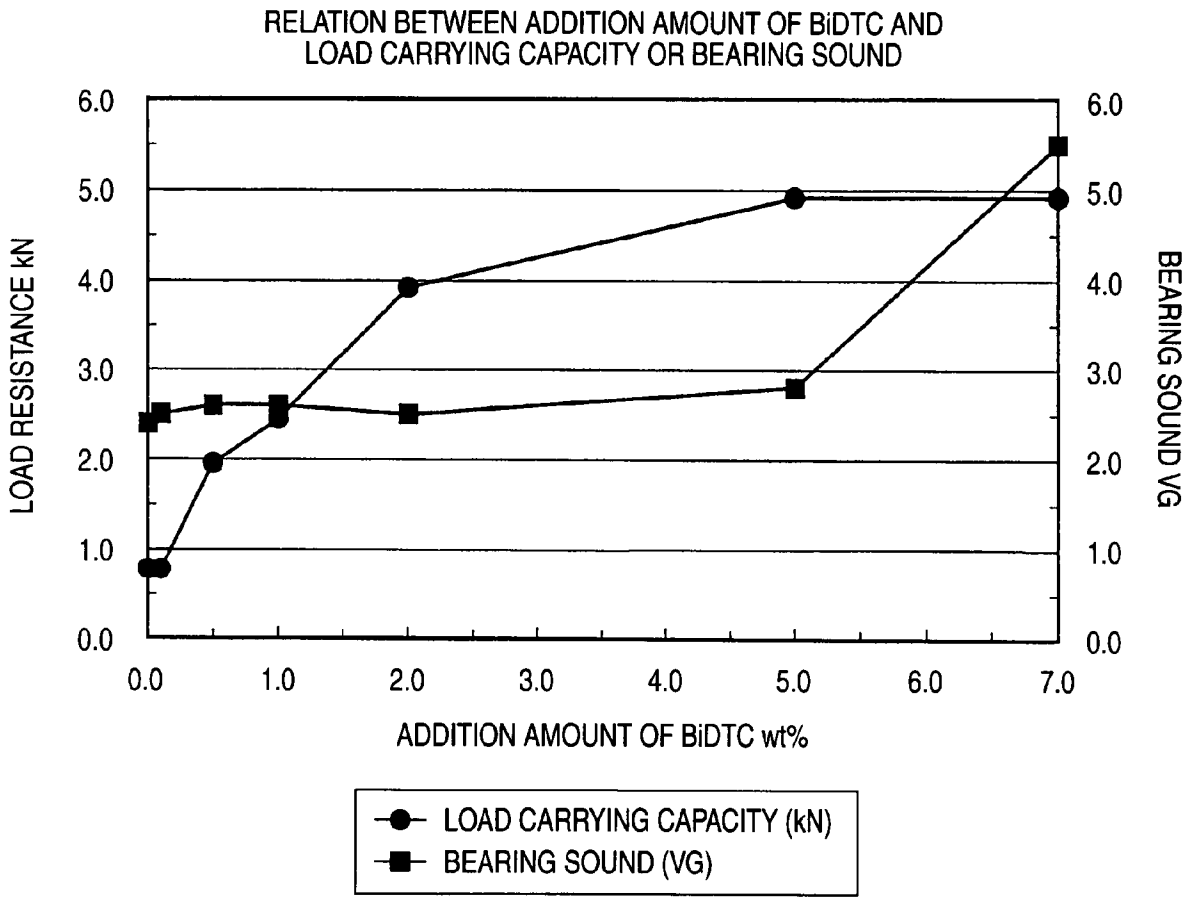
FIG. 1 is a graph showing a result obtained by measuring a load carrying capacity of a rolling bearing and a bearing sound while changing amounts of bismuth dithiocarbamate to be added in a grease composition according to the present invention.

The present invention will be hereinafter described in detail.

Bismuth (Bi) which is used in this bismuth dithiocarbamate is a heaviest element among stable elements but is known as being low in toxicity as opposed to neighboring heavy elements such as arsenic (As), antimony (Sb), lead (Pb) and thallium (Tl).

According to the present invention, by adding a bismuth dithiocarbamate (hereinafter, referred to also as "BiDTC" in short) to a urea grease comprising a lubricating base oil comprising a poly-α-olefin synthetic oil or a diphenyl ether synthetic oil and a diurea thickening agent, or a fluorine grease comprising a lubricating base oil comprising a fluorinated synthetic oil and a polytetrafluoroethylene thickening agent, the BiDTC reacts with a surface of a raceway of each of inner and outer rings or a surface of a rolling element, to thereby form a surface film of a bismuth oxide or a bismuth sulfide and the thus-formed surface film extends a rolling fatigue life span of the bearing. Therefore, the grease composition can maintain an excellent lubricity for the bearing for a long period of time even under severe conditions such as a high rotation, a high temperature and a heavy load. Further, the grease composition for the rolling bearing is low in harmfulness to a human body and gives little load to an environment.

Now, as a specific example of the bismuth dithiocarbamate, a bismuth dithiocarbamate constituted by side chains $R^1$ and $R^2$ which are same as or different from each other and each individually represents a hydrogen atom, an alkyl group having from 1 to 12 carbon atoms (for example, a butyl group or a dodecyl group) or an aryl group having from 6 to 8 carbon atoms in the general formula (1) can preferably be adopted, and a bismuth dialkyldithiocarbamate constituted by side chains $R^1$ and $R^2$ which are same as or different from each other and each individually represents an alkyl group having from 1 to 12 carbon atoms can more preferably be adopted.

The bismuth dialkyldithiocarbamate is easily dispersemixed in the grease base agent (mixture of base oil and thickening agent) and can form a homogeneous film on the surface of the raceway of each of the inner and outer rings of the bearing or the surface of the rolling element.

Further, an amount of the bismuth dithiocarbamate to be added is, based on an entire weight of the lubricating base oil and the thickening agent, preferably in the range of from 0.1 to 5% by weight.

When the amount of the BiDTC to be added is less than 0.1% by weight on the basis of the grease base agent, it is difficult to form the homogeneous film on the surface of the raceway of each of the inner and outer rings of the bearing or the surface of the rolling element and, accordingly, a sufficient effect can not be exerted. Further, since the BiDTC is a crystalline grain, it is considered that, when the amount thereof to be added is more than 5% by weight on the basis of the grease base agent, there is a risk of giving an influence to sound characteristics of the bearing and, besides, when it is used under a high temperature of more than 150° C., hardening of a sealing member made of rubber for use in sealing the grease of the bearing is accelerated. Therefore, the amount of the BiDTC to be added is, based on the grease base agent, preferably in the range of from 0.1 to 5% by weight.

Still further, as for the lubricating base oil comprising the poly-α-olefin synthetic oil or the diphenyl ether synthetic oil to be used in the urea grease according to the present invention, a lubricating base oil in which an entire amount is occupied by any one of these synthetic oils, another lubricating base oil which is a mixture of these synthetic oils or still another lubricating base oil in which any one of these synthetic oil as a primary oil is added with, for example, any one of other synthetic oils or a mineral oil can be used.

Further, as for the diurea thickening agent, a reaction product obtained by a synthesis of 4,4'-diphenylmethane diisocyanate, an alkylphenylamine and cyclohexylamine, another reaction product obtained by a synthesis of 4,4'-diphenylmethane diisocyanate, stearylamine and oleylamine or the like can be mentioned.

Still further, as for the lubricating base oil for use in the fluorine grease according to the present invention, any one of various types of fluorinated synthetic oil which contains fluorine in the molecule and has an excellent thermal resistance can be used and, particularly, a perfluoroalkylpolyether (hereinafter, referred to also as "PFPE" in short) is preferable. As for the polytetrafluoroethylene thickening agent which is concurrently used with the lubricating base oil, polytetrafluoroethylene (hereinafter, referred to also as "PTFE" in short) is preferable.

Yet still further, any one of these greases may be added with an appropriate amount of a known additive, for example, an antioxidant, a rust-preventive agent or an extreme pressure agent.

Next, the rolling bearing according to the present invention is characterized in that the grease composition according to the present invention is packed therein.

In the rolling bearing, the surface film of the bismuth oxide or the bismuth sulfide which reduces friction is formed on the surface of the raceway of any one of the inner and outer rings or the surface of the rolling element by using the grease composition according to the present invention. Therefore, the rolling bearing according to the present invention can be a rolling bearing which gives little influence to the human body or an ecosystem, is safe and has a long period of life span even under severe conditions such as the high rotation, the high temperature and the heavy load.

Further, according to the present invention, types of the rolling bearings are not particularly limited, and the present invention can be applied to various known types of rolling bearings. Still further, an amount of the grease to be packed in may be same as that of a known conventional rolling bearing and can appropriately be changed in accordance with the type, size or the like of the rolling bearing.

As has been described in detail, the grease composition for the rolling bearing according to the present invention can maintain the excellent lubricating performance of the rolling bearing for a long period of time under severe conditions, while using a component which is low in harmfulness to the human body.

Further, the rolling bearing in which the grease composition is packed can be a rolling bearing which gives little influence to the human body or the ecosystem, is safe and has a long period of life span even under severe conditions such as the high rotation, the high temperature and the heavy load.

Hereinafter, the present invention will be explained based on examples and comparative examples.

EXAMPLE 1

Urea Grease (PAO Base Oil):

128 g of p-dodecylaniline and 50 g of cyclohexylamine were mixed in 850 g of a poly-α-olefin (hereinafter, referred to also as "PAO" in short) which is a lubricating base oil and the mixture was heated to 100° C. with stirring to thereby prepare an amine solution (a).

Further, separately, 122 g of 4,4'-diphenylmethane diisocyanate was mixed in 850 g of PAO and the mixture was heated to 100° C. with stirring to thereby prepare an isocyanate solution (b).

Then, while stirring the isocyanate solution (b), the amine solution (a) was gradually added thereto and, then, the solutions (a) and (b) were allowed to react with each other to thereby generate a diurea compound (c) in the PAO.

Next, in order to allow the diurea compound (c) to be homogeneously dispersed in the PAO, the resultant reaction solution was heated to 150° C. with stirring, held at 150° C. for 30 minutes and, then, gradually cooled to room temperature.

Thereafter, the resultant dispersion was, while being continuously stirred, added with 40 g of an extreme pressure additive: bismuth dimethylditiocarbamate (hereinafter, referred to also as "BiDTC-Me" in short) represented by the following structural formula (2), 40 g of a diphenylamine-type antioxidant and 40 g of a metal sulfonate-type rust-preventive agent and, then, sufficiently subjected to roll mill treatment, to thereby obtain a grease composition for a rolling bearing (ratio of BiDTC to entire weight of base oil and thickening agent: 2% by weight):

(2)

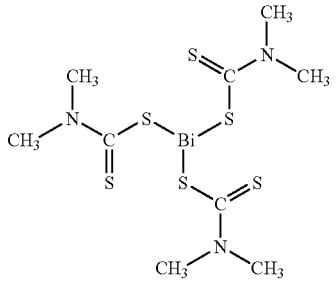

EXAMPLE 2

Urea Grease (ADE Base Oil):

A grease composition for a rolling bearing was obtained in a same manner as in EXAMPLE 1, except that a same amount (850 g) of an alkyldipenyl ether (hereinafter, referred to also as "ADE" in short) as that of the PAO was used as a lubricating base oil in place of the PAO (rate of BiDTC to entire weight of base oil and thickening agent: 2% by weight).

EXAMPLE 3

Urea Grease (ADE Base Oil):

A grease composition for a rolling bearing was obtained in a same manner as in EXAMPLE 1, except that a same amount (850 g) of ADE as that of the PAO was used as a lubricating base oil in place of the PAO and, also, a same amount of bismuth dibutyldithiocarbamate (hereinafter, referred to also as "BiDTC-Bu") represented by the following general formula (3) as that of the BiDTC-Me was used as an extreme pressure additive in place of the BiDTC-Me (rate of BiDTC to entire weight of base oil and thickening agent: 2% by weight):

(3)

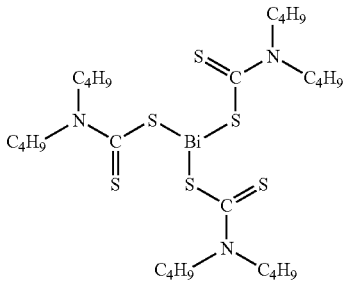

EXAMPLE 4

Fluorine Grease:

1520 g of a perfluoroalkylpolyether (PFPE) as a lubricating base oil and 480 g of polytetrafluoroethylene (PTFE) as a thickening agent were filled in a container made of stainless steel and, then, stirred at room temperature to be gelated (d).

Next, 40 g of an extreme pressure additive: BiDTC-Me represented by the aforementioned structural formula (2), 40 g of a diphenylamine-type antioxidant and 40 g of a metal sulfonate-type rust-preventive agent were added to the resultant gelated solution (d) and, then, sufficiently subjected to roll mill treatment, to thereby obtain a grease composition for a rolling bearing (rate of BiDTC to entire weight of base oil and thickening agent: 2% by weight).

COMPARATIVE EXAMPLE 1

Urea Grease (PAO Base Oil):

A grease composition for a rolling bearing was obtained in a same manner as in EXAMPLE 1, except that an amount of the BiDTC-Me as an extreme pressure additive was changed into 2 g (rate of BiDTC to entire weight of base oil and thickening agent: 0.1% by weight).

COMPARATIVE EXAMPLE 2

Urea Grease (PAO Base Oil):

A grease composition for a rolling bearing was obtained in a same manner as in EXAMPLE 1, except that an extreme pressure additive was not added.

COMPARATIVE EXAMPLE 3

Urea Grease (PAO Base Oil):

A grease composition for a rolling bearing was obtained in a same manner as in EXAMPLE 1, except that a same amount (40 g) of potassium borate as that of the BiDTC-Me was added as an extreme pressure additive in place of the BiDTC-Me.

COMPARATIVE EXAMPLE 4

Urea Grease (PAO Base Oil):

A grease composition for a rolling bearing was obtained in a same manner as in EXAMPLE 1, except that a same amount (40 g) of zinc dialkyldithiocarbamate (hereinafter, referred to also as "ZnDTC" in short) represented by the following general formula (4) as that of the BiDTC-Me was added as an extreme pressure additive in place of the BiDTC-Me:

(4)

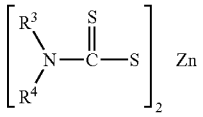

wherein $R^3$ and $R^4$ are same as or different from each other and each individually represents an alkyl group.

COMPARATIVE EXAMPLE 5

Urea Grease (PAO Base Oil):

A grease composition for a rolling bearing was obtained in a same manner as in EXAMPLE 1, except that a same amount (40 g) of antimony dithiocarbamate (hereinafter, referred to also as "SbDTC" in short) represented by the following general formula (5) as that of the BiDTC-Me was added as an extreme pressure additive in place of the BiDTC-Me:

(5)

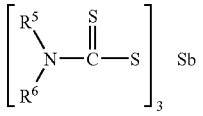

wherein $R^5$ and $R^6$ are same as or different from each other and each individually represents a hydrogen atom, an alkyl group or an aryl group.

COMPARATIVE EXAMPLE 6

Urea Grease (PAO Base Oil):

A grease composition for a rolling bearing was obtained in a same manner as in EXAMPLE 1, except that a same amount (40 g) of molybdenum dithiocarbamate (hereinafter, referred to also as "MoDTC" in short) represented by the following general formula (6) as that of the BiDTC-Me was added as an extreme pressure additive in place of the BiDTC-Me:

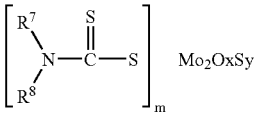

(6)

wherein $R^7$ and $R^8$ are same as or different from each other and each individually represents a hydrogen atom, an alkyl group or an aryl group; and x, y and z each individually represent an arbitrary number.

COMPARATIVE EXAMPLE 7

Urea Grease (ADE Base Oil):

A grease composition for a rolling bearing was obtained in a same manner as in EXAMPLE 2, except that an extreme pressure additive was not added.

COMPARATIVE EXAMPLE 8

Urea Grease (ADE Base Oil):

A grease composition for a rolling bearing was obtained in a same manner as in EXAMPLE 2, except that a same amount (40 g) of SbDTC represented by the aforementioned general formula (5) as that of the BiDTC-Me was used as an extreme pressure additive in place of the BiDTC-Me.

COMPARATIVE EXAMPLE 9

Urea Grease (ADE Base Oil):

A grease composition for a rolling bearing was obtained in a same manner as in EXAMPLE 2, except that a same amount (40 g) of MoDTC represented by the aforementioned general formula (6) as that of the BiDTC-Me was used as an extreme pressure additive in place of the BiDTC-Me.

COMPARATIVE EXAMPLE 10

Fluorine Grease:

A grease composition for a rolling bearing was obtained in a same manner as in EXAMPLE 4, except that an extreme pressure additive was not added.

COMPARATIVE EXAMPLE 11

Fluorine Grease:

A grease composition for a rolling bearing was obtained in a same manner as in EXAMPLE 4, except that a same amount (40 g) of SbDTC represented by the aforementioned general formula (5) as that of the BiDTC-Me was used as an extreme pressure additive in place of the BiDTC-Me.

COMPARATIVE EXAMPLE 12

Fluorine Grease:

A grease composition for a rolling bearing was obtained in a same manner as in EXAMPLE 4, except that a same amount (40 g) of MoDTC represented by the aforementioned general formula (6) as that of the BiDTC-Me was used as an extreme pressure additive in place of the BiDTC-Me.

Next, methods and conditions of various types of tests which have been used in Examples and Comparative Examples are described.

Measurement of Worked Penetration

A worked penetration value (60W) of each of lubricant compositions prepared by Examples and Comparative Examples was measured in accordance with a measuring method defined in Japanese Industrial Standards JIS K 2220 "Grease".

Measurement of Load Carrying Capacity

Load carrying capacity of each of grease compositions prepared in Examples and Comparative Examples was measured in accordance with a four-ball extreme-pressure lubricant test—weld load measuring method defined in ASTM (American Society for Testing and Material) standards ASTM D 2596 (measurement of extreme-pressure properties of lubricating grease (four-ball method)).

(Operating Conditions)

Rotation speed: 1770 rpm; and

Temperature: room temperature.

Measurement of Rolling Fatigue Life Span 2 g of grease composition prepared by each of Examples and Comparative Examples was filled in a radial deep groove ball bearing (called as "6303 2RD) with both ends sealed and, then, the bearing was operated for 1000 hours under conditions of high temperature and heavy load as described below and, thereafter, a time period until flaking occurred on a surface of a raceway to cause a damage on the bearing was measured.

(Operating Conditions)

Rotation speed: 18000 rpm;

Radial load: 250 kg;

Temperature: 90° C.; and

Rated load: 13.5 KN.

Test results are shown in Tables 1 to 3 in groups by base oil.

Compounds corresponding to respective abbreviation in Tables 1 to 3 and trade names thereof which were actually used are as follows:

PAO: poly-α-olefin

ADE: alkyldiphenyl ether

MDI: 4,4'-diphenylmethane diisocyanate

PDA: p-dodecylaniline

CHA: cyclohexylamine

KBR: potassium borate

PFPE: perfluoroalkyl polyether

PTFE: polytetrafluoroethylene

ZnDTC: zinc dialkyldithiocarbamate

SbDTC: antimony dithiocarbamate (antimony tris(dialkyldithiocarbamate); VANLUBE 73 (trade name); available from R. T. Vanderbilt Company, Inc.)

MoDTC: molybdenum dithiocarbamate (molybdenum di-n-butyldithiocarbamate; MOLYVAN A (trade name); available from R. T. Vanderbilt Company, Inc.)

BiDTC-Me: bismuth dimethyldithiocarbamate (bismuth dimethyldithiocarbamate; BISMATE (trade name); available from R. T. Vanderbilt Company, Inc.)

BiDTC-Bu: bismuth dibutyldithiocarbamate

TABLE 1

| Formula/Physical properties | | Example 1 | Comparative Example 1 | Comparative Example 2 | Comparative Example 3 | Comparative Example 4 | Comparative Example 5 | Comparative Example 6 |
|---|---|---|---|---|---|---|---|---|
| Base oil (g) | PAO | 1700 | 1700 | 1700 | 1700 | 1700 | 1700 | 1700 |
| Thickening agent (g) | MDI | 122 | 122 | 122 | 122 | 122 | 122 | 122 |
| | PDA | 128 | 128 | 128 | 128 | 128 | 128 | 128 |
| | CHA | 50 | 50 | 50 | 50 | 50 | 50 | 50 |
| Extreme pressure additive (g) | BiDTC-Me | 40 | 2 | — | | | | |
| | KBR | | | — | 40 | | | |
| | ZnDTC | | | — | | 40 | | |
| | SbDTC | | | — | | | 40 | |
| | MoDTC | | | — | | | | 40 |
| Diphenylamine-type antioxidant (g) | | 40 | 40 | 40 | 40 | 40 | 40 | 40 |
| Metal sulfonate-type rust-preventive agent (g) | | 40 | 40 | 40 | 40 | 40 | 40 | 40 |
| Penetration (60 Work) | | 265 | 272 | 273 | 269 | 270 | 272 | 275 |
| Load carrying capacity kN | | 3.09 | 0.78 | 0.78 | 0.98 | 0.98 | 1.96 | 1.57 |
| Bearing life (time period until flaking occurred) | | >1000 No flaking | 108 Flaking | 85 Flaking | 176 Flaking | 103 Flaking | >1000 No flaking | >1000 No flaking |

TABLE 2

| Formula/Physical properties | | Example 2 | Example 3 | Comparative Example 7 | Comparative Example 8 | Comparative Example 9 |
|---|---|---|---|---|---|---|
| Base oil (g) | ADE | 1700 | 1700 | 1700 | 1700 | 1700 |
| Thickening agent (g) | MDI | 122 | 122 | 122 | 122 | 122 |
| | PDA | 128 | 128 | 128 | 128 | 128 |
| | CHA | 50 | 50 | 50 | 50 | 50 |
| Extreme pressure additive (g) | BiDTC-Me | 40 | | — | | |
| | BiDTC-Bu | | 40 | — | | |
| | SbDTC | | | — | 40 | |
| | MoDTC | | | — | | 40 |
| Diphenylamine-type antioxidant (g) | | 40 | 40 | 40 | 40 | 40 |
| Metal sulfonate-type rust-preventive agent (g) | | 40 | 40 | 40 | 40 | 40 |
| Penetration (60 Work) | | 260 | 263 | 262 | 250 | 262 |
| Load carrying capacity kN | | 3.92 | 2.45 | 0.78 | 1.96 | 1.57 |
| Bearing life (time period until flake occurred) | | >1000 No flake | >1000 No flake | 750 Flake | >1000 No flake | >1000 No flake |

TABLE 3

| Formula/Physical properties | | Example 4 | Comparative Example 10 | Comparative Example 11 | Comparative Example 12 |
|---|---|---|---|---|---|
| Base oil (g) | PFPE | 1520 | 1520 | 1520 | 1520 |
| Thickening agent (g) | PTFE | 480 | 480 | 480 | 480 |
| Extreme pressure additive (g) | BiDTC-Me | 40 | — | | |
| | SbDTC | | — | 40 | |
| | MoDTC | | — | | 40 |
| Diphenylamine-type antioxidant (g) | | 40 | 40 | 40 | 40 |
| Metal sulfonate-type rust-preventive agent (g) | | 40 | 40 | 40 | 40 |
| Penetration (60 Work) | | 263 | 274 | 268 | 275 |
| Load carrying capacity kN | | 2.45 | 0.78 | 1.96 | 1.57 |
| Bearing life (time period until flake occurred) | | >1000 No flake | 78 Flake | >1000 No flake | >1000 No flake |

As is apparent from the above-described Tables, the rolling bearing according to the present invention (Examples 1 to 4) showed a rolling fatigue life span of more than 1000 hours in a measurement of bearing life span. Therefore, it was found that the rolling bearings in which the grease composition added with the BiDTC according to the present invention was packed had each drastically extended the life span compared with Comparative Examples which used the grease which had not been added with the extreme pressure additive.

Further, also in the urea grease comprising the PAO or the ADE as a base oil or the fluorine grease comprising the PFPE as a base oil, an effect of extending the life span similar to or more than that of a case in which the SbDTC or the MoDTC which had been used in the previous patent application was added was confirmed.

Still further, from the measuring results of the load carrying capacity, in each of the urethane grease which uses the PAO or the ADE as a base oil and the fluorine grease which uses the PFPE as a base oil, an effect of improving the load carrying capacity similar to or more than that of a case in which SbDTC or MoDTC which had been used in the previous patent application was added was confirmed.

Next, results obtained by measuring changes of load carrying capacity of the grease compositions and, also, changes of sound characteristics of the bearings in which these grease compositions were packed to be effected by changing the amounts of BiDTC to be added will be described.

The grease composition put on the test had same composition as in Example 2 and measurement was performed, while changing the amounts of BiDTC to be added in the range of from 0 to 7%. Further, the load carrying capacity test of the grease composition was performed in a same manner under same conditions as defined in the aforementioned ASTM D 2596 and, accordingly, detailed description is omitted.

Measurement of Bearing Sound

Each of grease compositions which each had the similar composition to that of EXAMPLE 2 and in which rates of BiDTC to an entire weight of the base oil and the thickening agent were adjusted to be 0.1% by weight, 0.5% by weight, 1.0% by weight, 2.0% by weight, 5.0% by weight and 7.0% by weight, respectively was packed in a thrust ball bearing (called as 62022RU) by 1 g and, then, an acceleration-type pick-up was allowed to be in contact with an outer diameter of an outer ring of the bearing and, thereafter, a vibration value (VG) was measured while rotating the ball bearing under such conditions as described below. Further, the sound (vibration value) thereof was measured 120 seconds after the rotation was started. An average of measurements of 5 times was determined as a measurement value.

(Operating Conditions)

Rotation speed: 1800 rpm;

Thrust load: 19.6 N; and

Temperature: 25° C.

The results are shown in FIG. 1. As is apparent from FIG. 1, even when BiDTC was added by 5% by weight or more, it was observed that there was no effect of further improving the load carrying capacity, whereas bearing sound was remarkably deteriorated. Therefore, a preferable addition rate of BiDTC in the grease composition according to the present invention is, based on an entire weight of the lubricating base oil and the thickening agent, in the range of from 0.1 to 5% by weight.

While the invention has been described in detail and with reference to specified embodiments thereof, it will be apparent to one skilled in the art that various changes and modifications can be made therein without departing from the spirit and scope thereof.

This application is based on Japanese Patent Application No. 2003-191578 filed on Jul. 4, 2003, the entire contents thereof being hereby incorporated by reference.

What is claimed is:

1. A grease composition for a rolling bearing, comprising:

a lubricating base oil comprising a diphenyl ether synthetic oil;

a diurea thickening agent; and a bismuth dithiocarbamate represented by the following general formula (1):

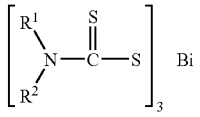

(1)

in which $R^1$ and $R^2$ are same as or different from each other and each individually represents a hydrogen atom, an alkyl group comprising 1 to 12 carbon atoms, or an aryl group comprising 6 to 8 carbon atoms, wherein the bismuth dithiocarbamate comprises a range of 0.5% to 5% by weight based on an entire weight of the lubricating base oil and the thickening agent, such that a sound characteristic of the rolling bearing is not affected by said bismuth dithiocarbamate, and a load-carrying capacity is improved by reacting said bismuth dithiocarbamate with one of a surface of a raceway of inner and outer rings of said rolling bearing and a surface of a rolling element of the rolling bearing to thereby form a surface film of one of bismuth oxide and bismuth sulfide.

2. A grease composition for a rolling bearing, comprising:

a lubricating base oil comprising a fluorinated synthetic oil;

a polytetrafluoroethylene thickening agent; and a bismuth dithiocarbamate represented by the following general formula (1):

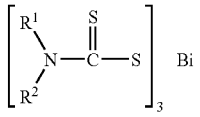

(1)

in which $R^1$ and $R^2$ are same as or different from each other and each individually represents a hydrogen atom, an alkyl group comprising 1 to 12 carbon atoms, or an aryl group comprising 6 to 8 carbon atoms, wherein the bismuth dithiocarbamate comprises a range of 0.5% to 5% by weight based on an entire weight of the lubricating base oil and the thickening agent, such that a sound characteristic of the rolling bearing is not affected by said bismuth dithiocarbamate, and a load-carrying capacity is improved by reacting said bismuth dithiocarbamate with one of a surface of a raceway of inner and outer rings of said rolling bearing and a surface of a rolling element of the rolling bearing to thereby form a surface film of one of bismuth oxide and bismuth sulfide.

3. A rolling bearing, wherein the grease composition for the rolling bearing as set forth in claim 1 is packed therein.

4. A rolling bearing, wherein the grease composition for the rolling bearing as set forth in claim 2 is packed therein.

5. The grease composition as claimed in claim 1, further comprising an amine antioxidant.

6. The grease composition as claimed in claim 5, wherein the amine antioxidant comprises a diphenylamine antioxidant.

7. The grease composition as claimed in claim 1, further comprising a metal sulfonate rust-preventive agent.

8. The grease composition as claimed in claim 1, wherein the bismuth dithiocarbamate comprises a range of 2.0% to 5% by weight based on an entire weight of the lubricating base oil and the thickening agent.

9. The grease composition as claimed in claim 2, further comprising an amine antioxidant.

10. The grease composition as claimed in claim 9, wherein the amine antioxidant comprises a diphenylamine antioxidant.

11. The grease composition as claimed in claim 2, further comprising a metal sulfonate rust-preventive agent.

12. The grease composition as claimed in claim 2, wherein the bismuth dithiocarbamate comprises a range of 2.0% to 5% by weight based on an entire weight of the lubricating base oil and the thickening agent.

13. An auxiliary device of an automotive engine comprising the rolling bearing as set forth in claim 3.

14. An auxiliary device of an automotive engine comprising the rolling bearing as set forth in claim 4.

15. An alternator comprising the rolling bearing as set forth in claim 3.

16. An alternator comprising the rolling bearing as set forth in claim 4.

* * * * *